US009683726B2

(12) United States Patent
Seki

(10) Patent No.: US 9,683,726 B2
(45) Date of Patent: Jun. 20, 2017

(54) LAMP AND LIGHTING APPARATUS

(71) Applicant: PANASONIC INTELLECTUAL PROPERTY MANAGEMENT CO., LTD., Osaka (JP)

(72) Inventor: Katsushi Seki, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 188 days.

(21) Appl. No.: 14/391,492

(22) PCT Filed: Mar. 28, 2013

(86) PCT No.: PCT/JP2013/002133
§ 371 (c)(1),
(2) Date: Oct. 9, 2014

(87) PCT Pub. No.: WO2013/153758
PCT Pub. Date: Oct. 17, 2013

(65) Prior Publication Data

US 2015/0103528 A1 Apr. 16, 2015

(30) Foreign Application Priority Data

Apr. 13, 2012 (JP) ..... 2012-092440

(51) Int. Cl.
*F21V 19/00* (2006.01)
*F21V 29/00* (2015.01)
(Continued)

(52) U.S. Cl.
CPC ..... *F21V 19/0055* (2013.01); *F21V 19/0035* (2013.01); *F21V 29/004* (2013.01);
(Continued)

(58) Field of Classification Search
CPC .. F21V 19/003; F21V 19/004; F21V 19/0055; F21V 19/0038; F21V 17/005; F21S 8/02
See application file for complete search history.

(56) References Cited

U.S. PATENT DOCUMENTS 7,290,913 B2 11/2007 Watanabe et al.
7,988,336 B1 8/2011 Harbers et al.
(Continued)

FOREIGN PATENT DOCUMENTS

CN 1715501 1/2006
CN 1740632 3/2006
(Continued)

OTHER PUBLICATIONS

Office Action issued in China Counterpart Patent Appl. No. 201380019755.X, dated Dec. 23, 2015 , along with an English translation thereof.
(Continued)

*Primary Examiner* — Robert May
*Assistant Examiner* — Leah S Macchiarolo
(74) *Attorney, Agent, or Firm* — Greenblum & Bernstein, P.L.C.

(57) ABSTRACT

A lamp that emits light and includes: a mounting board on which a light-emitting element is provided; a support disposed on a side opposite a light-emission-side of the mounting board; and a case connected to a support. The case includes a securing part which is disposed on the light-emission-side of the mounting board, and secures the mounting board to the support by sandwiching the mounting board between the securing part and the support.

13 Claims, 7 Drawing Sheets

(51) Int. Cl.
*F21S 8/02* (2006.01)
*F21V 17/00* (2006.01)
*F21Y 115/10* (2016.01)

(52) U.S. Cl.
CPC ..... *F21S 8/02* (2013.01); *F21V 17/005* (2013.01); *F21V 19/004* (2013.01); *F21Y 2115/10* (2016.08)

(56) References Cited

U.S. PATENT DOCUMENTS

| | | | | |
|---|---|---|---|---|
| 8,348,478 | B2 | 1/2013 | Pelton et al. | |
| 8,414,178 | B2 * | 4/2013 | Alexander | F21S 48/328 362/294 |
| 8,602,608 | B2 | 12/2013 | Derks et al. | |
| 8,714,785 | B2 | 5/2014 | Osada et al. | |
| 2006/0044840 | A1 | 3/2006 | Watanabe et al. | |
| 2006/0262544 | A1 | 11/2006 | Piepgras et al. | |
| 2007/0279921 | A1 * | 12/2007 | Alexander | F21V 15/01 362/368 |
| 2008/0130308 | A1 | 6/2008 | Behr et al. | |
| 2011/0063837 | A1 * | 3/2011 | Rizkin | F21V 19/001 362/235 |
| 2012/0051056 | A1 | 3/2012 | Derks et al. | |
| 2012/0051068 | A1 | 3/2012 | Pelton et al. | |
| 2013/0039072 | A1 * | 2/2013 | Kim | F21V 29/006 362/294 |
| 2013/0201697 | A1 | 8/2013 | Osada et al. | |

FOREIGN PATENT DOCUMENTS

| | | |
|---|---|---|
| EP | 2 423 572 | 2/2012 |
| JP | 2010-129382 | 6/2010 |
| JP | 2010-199010 | 9/2010 |
| JP | 2011-029095 | 2/2011 |
| JP | 2011-040238 | 2/2011 |
| JP | 2011-154815 | 8/2011 |
| JP | 2012-049530 | 3/2012 |
| JP | 2012-069396 | 4/2012 |
| WO | 2012/005239 | 1/2012 |
| WO | 2012/005244 | 1/2012 |

OTHER PUBLICATIONS

Search report from PCT/JP2013/002133, mail date is May 24, 2013.
U.S. Appl. No. 14/520,750 to Yamauchi et al., filed Oct. 22, 2014.
Office Action issued in European Patent Office (EPO) Counterpart Patent Appl. No. 13716071.9, dated Oct. 4, 2016.

* cited by examiner

LAMP AND LIGHTING APPARATUS

TECHNICAL FIELD

The present invention relates to a lamp using a light-emitting element such as a light-emitting diode (LED) as a light source and to a lighting apparatus including the lamp.

BACKGROUND ART

Conventionally, disc-shaped or low-profile LED lamps using LEDs as a light source have been proposed (for example, see Patent Literature (PTL) 1). Generally, such LED lamps include a disk-shaped or low-profile case, and an LED board on which an LED is mounted and a support which supports the LED board are disposed inside the case.

CITATION LIST

Patent Literature

[PTL 1]
International Publication No. WO2012/005239

SUMMARY OF INVENTION

Technical Problem

In the conventional LED lamp, a securing component is used in order to secure the LED board to the support. FIG. 10 is a diagram showing a configuration for securing the LED board to the support in the conventional LED lamp. As shown in the figure, in the conventional LED lamp, a securing component 130 for securing is used to secure an LED substrate 120 to a support 110.

As such, in the conventional LED lamp, a special component is required in order to secure the LED board to the support, and thus there is the problem that the configuration becomes complex which leads to an increase in material cost and assembly cost.

The present invention is conceived in order to solve the aforementioned problem and has as an object to provide a lamp and a lighting apparatus in which the LED board can be secured to the support using a simple configuration.

Solution to Problem

In order to achieve the aforementioned object, a lamp according to an aspect of the present invention is a lamp that emits light and includes: a board on which a light-emitting element is provided; a support disposed on a side opposite a light-emission-side of the board; and a case connected to the support, wherein the case includes a securing part which is disposed on the light-emission-side of the board, and secures the board to the support by sandwiching the board between the securing part and the support.

Furthermore, a lamp according to an aspect of the present invention may further include a reflecting part which is disposed on the light-emission-side of the board, and reflects the light emitted from the light-emitting element, wherein the reflecting part may be disposed inside the case.

Furthermore, the securing part may secure the board to the support by exerting a pressing force against the board.

Furthermore, the securing part may be disposed to abut the board from an oblique direction.

Furthermore, A lamp according to an aspect of the present invention may further include a filling component which is disposed between the board and the support, and fills a space between the board and the support.

Furthermore, the filling component may be a heat-conducting sheet that thermally connects the board and the support.

Furthermore, the filling component may be an insulating sheet that provides insulation between the board and the support.

Furthermore, the support may include a guide component for positioning the board.

Furthermore, in order to achieve the aforementioned object, a lighting apparatus according to an aspect of the present invention includes: the above-described lamp; and lighting equipment to which the lamp is attached, wherein the lighting equipment includes: a main body configured to cover the lamp; and a socket attached to the main body, for supplying power to the lamp.

Advantageous Effects of Invention

The lamp and lighting apparatus according to the present invention allow securing of an LED board to a support using a simple configuration.

DESCRIPTION OF EMBODIMENTS

Hereinafter, lamps and lighting apparatuses according to exemplary embodiments of the present invention shall be described with reference to the Drawings. It should be noted that each of subsequently-described embodiments show one specific preferred example of the present invention. The numerical values, shapes, materials, structural components, the arrangement and connection of the structural components, etc. shown in the following exemplary embodiments are mere examples, and are not intended to limit the scope of the present invention. Furthermore, among the structural components in the following exemplary embodiments, components not recited in any one of the independent claims are described as arbitrary structural components included in a more preferable form. Moreover, in the respective figures, dimensions, etc. are not precise. Furthermore, in the present application, numerical ranges defined using the word "between" include the numerical values at both end-points.

Embodiment 1

First, an outline configuration of a lamp 1 according to Embodiment 1 of the present invention shall be described.

Figure 1A:
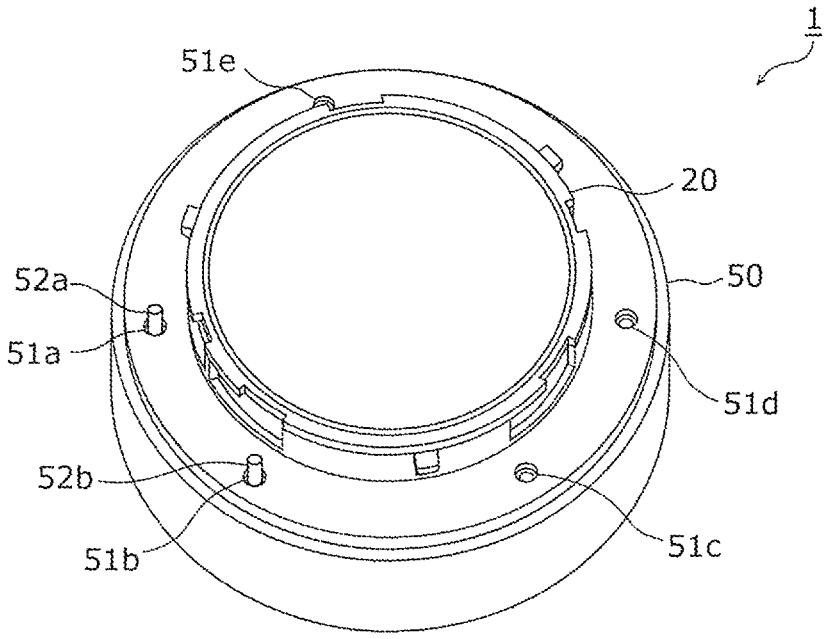
FIG. 1A is a perspective view of an external appearance of a lamp according to Embodiment 1 of the present invention.
Figure 1B:
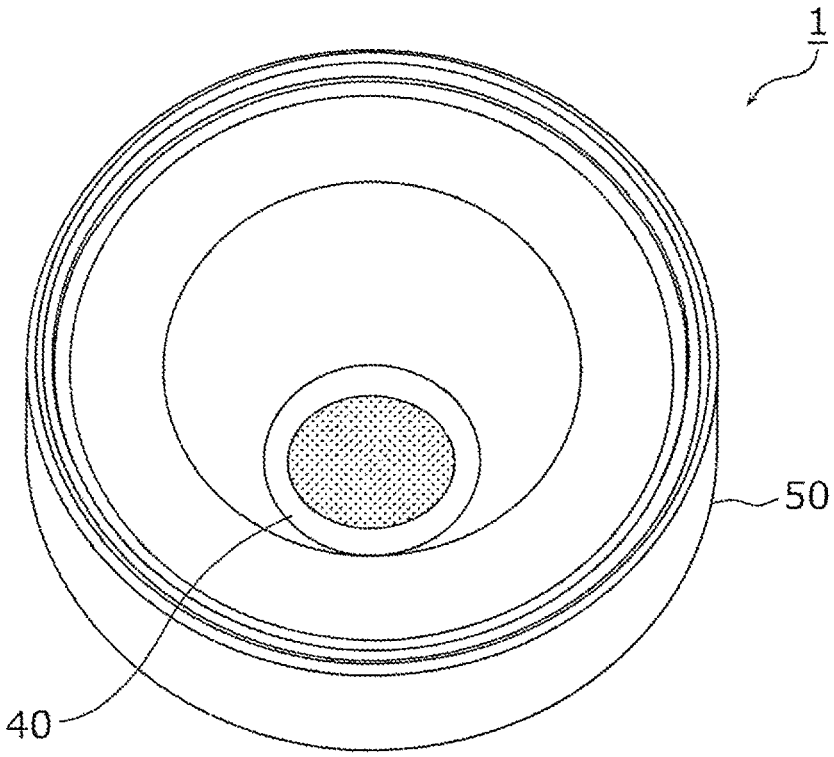
FIG. 1B is a perspective view of an external appearance of the lamp according to Embodiment 1 of the present invention.

FIG. 1A and FIG. 1B are perspective views of the external appearance of the lamp 1 according to Embodiment 1 of the present invention. Specifically, FIG. 1A is a perspective view of the lamp 1 when viewed obliquely from above, and FIG. 1B is a perspective view of the lamp 1 when viewed obliquely from below. It should be noted that, although an opening of the lamp 1 is covered by a cover, the cover is of a transparent material and thus the inside of the lamp 1 can be seen through the cover in FIG. 1B.

As shown in these figures, the lamp 1 is an LED lamp having a disk-like or low-profile overall shape. Specifically, the lamp 1 is an LED lamp having a GH76p base. More specifically, the lamp 1 has, for example, an outer diameter of between 50 and 100 mm and a height of between 30 and 50 mm, and when the lamp is a 20 W LED lamp, for example, the outer diameter is 90 mm and the height is 45 mm.

Furthermore, the lamp 1 includes a support 20 that is attached to lighting equipment (not illustrated), a mounting board 40 on which a light-emitting element is provided, and a case 50 that is connected to the support 20.

It should be noted that, in FIG. 1A, the lamp is illustrated in such a way that the side where light is elicited from the lamp (hereafter called light-emission-side) is the underside, and, in FIG. 1B, the lamp is illustrated in such a way that the light-emission-side is the topside. Hereinafter, in this embodiment, up (topside) and down (underside) shall be defined with reference to the state in which an LED lamp is disposed such that the light-emission-side is the underside, as in FIG. 1A.

Furthermore, five through holes 51 (through holes 51*a* to 51*e* in the figure) are formed in a circle in the top face (face on the lighting equipment-side) of the case 50. An electrical connection pin 52 for electrically connecting with the lighting equipment is inserted in each through hole 51. It should be noted that, although electrical connection pins 52*a* and 52*b* are inserted through the through holes 51*a* and 51*b* in the figure, electrical connection pins 52*c* to 52*e* (not illustrated) are also inserted through the through holes 51*c* to 51*e*, respectively. Here, for example, the electrical connection pins 52*a* and 52*b* are power supply pins, the electrical connection pins 52*c* and 52*d* are light adjustment pins, and the electrical connection pin 52*e* is a grounding pin. It should be noted that, for example, in the case where light adjustment will not be performed, the through holes 51*c* and 51*d* are not formed and the electrical connection pins 52*c* and 52*d* are not inserted.

Next, the detailed configuration of the lamp 1 according to Embodiment 1 of the present invention shall be described.

Figure 2:
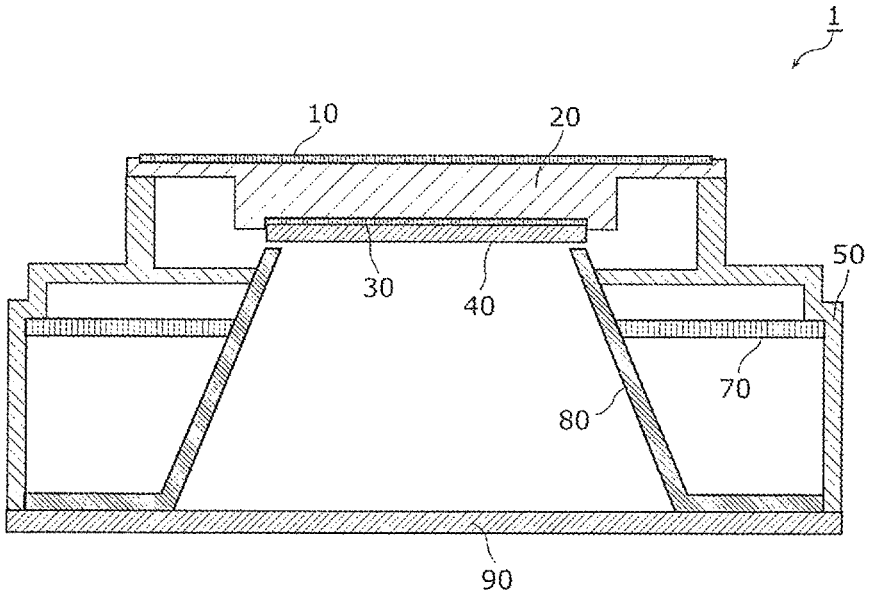
FIG. 2 is a diagram showing a configuration of the lamp according to Embodiment 1 of the present invention.
Figure 3:
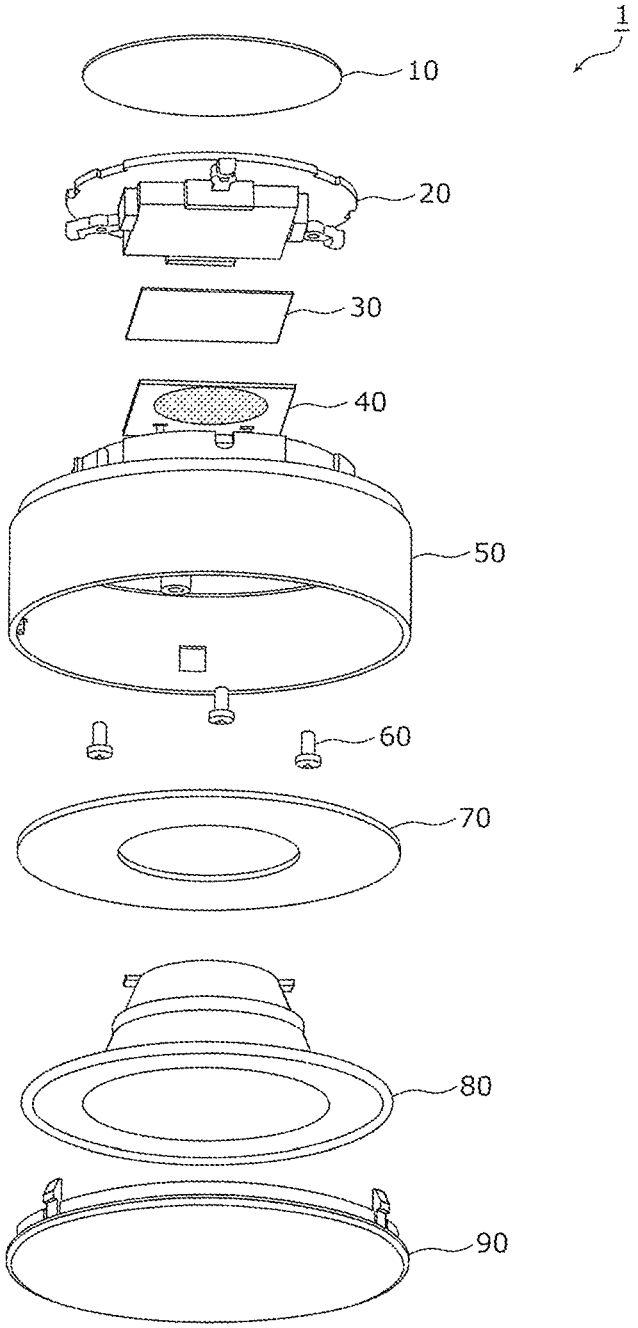
FIG. 3 is a diagram showing a configuration of the lamp according to Embodiment 1 of the present invention.

FIG. 2 and FIG. 3 are diagrams showing the configuration of the lamp 1 according to Embodiment 1 of the present invention. Specifically, FIG. 2 is an outline diagram of the cross-section obtained when the lamp 1 is cut vertically, and FIG. 3 is a diagram showing the respective structural components when the lamp 1 is disassembled.

As shown in these figures, the lamp 1 includes a heat-conducting sheet 10, the support 20, a filling component 30, the mounting board 40, the case 50, securing screws 60, a circuit board 70, a reflecting mirror 80, and a light-transmissive cover 90.

The heat-conducting sheet 10 is a heat-conductive sheet for releasing, to the lighting equipment-side, the heat from the mounting board 40 that is transmitted via the support 20. Specifically, the heat-conducting sheet 10 is a sheet made of rubber or resin, and is, for example, a silicon sheet or an acrylic sheet.

The support 20 is a component that is connected to the lighting equipment. Specifically, for example, a GH76p base structure is formed in the upper part of the support 20, and is attached and secured to the lighting equipment.

Furthermore, the support 20 is a pedestal on which the mounting board 40 is attached, and is disposed on a side opposite the light-emission-side of the mounting board 40. Furthermore, it is preferable that the support 20 be made of highly heat-conductive material such as aluminum.

The filling component 30 is a component disposed between the support 20 and the mounting board 40, for filling the space between the support 20 and the mounting board 40. In other words, the filling component 30 is a component made of a soft material that, when disposed between the support 20 and the mounting board 40, assumes a shape that conforms to the shape of the space between the support 20 and the mounting board 40.

Here, it is preferable that the filling component 30 be a heat-conducting sheet that thermally connects the mounting board 40 and the support 20. Furthermore, it is more preferable that the filling component 30 be an insulating sheet that provides insulation between the mounting board 40 and the support 20. Specifically, the filling component 30 is a sheet made of rubber or resin, and is, for example, a silicon sheet or an acrylic sheet.

In this manner, when the filling component 30 is a heat-conducting sheet that thermally connects the mounting board 40 and the support 20, the filling component 30 can efficiently transfer the heat from the mounting board 40 to the support 20 and thereby release the heat to the lighting equipment-side. Furthermore, since the filling component 30 is a component that fills the space between the support 20 and the mounting board 40, the filling component 30 can effectively transfer the heat from the mounting board 40 to the support 20.

Furthermore, when the filling component 30 is an insulating sheet that provides insulation between the mounting board 40 and the support 20, the filling material 30 can, for example, in the case where the mounting board 40 is a board made of metal, prevent the mounting board 40 and the support 20 from becoming electrically connected.

It should be noted that, it is sufficient that the filling component 30 be a component for filling the space between the support 20 and the mounting board 40, and is not limited to the sheet-like component described above. For example, the filling component 30 may be a liquid component such as grease.

The mounting board 40 is a board on which a light-emitting element such as a semiconductor light-emitting element, which is a light-emitting unit, is provided. Specifically, an LED chip is mounted on the mounting board 40. The mounting board 40 is, for example, configured to be plate-like, and has one face on which the LED chip is mounted, and another face that can be thermally connected to the support 20. Detailed description of the light-emitting unit provided on the mounting board 40 shall be provided later.

Furthermore, it is preferable that the mounting board 40 be made of highly heat-conductive material, and is, for example, made of an alumina substrate made of alumina. It should be noted that, aside from an alumina substrate, a ceramic substrate made of other ceramic material such as aluminum nitride, metal substrates made of aluminum, copper, or the like, or a metal-core substrate having a stacked structure of a metal plate and a resin substrate may be used for the mounting board 40. It should be noted that the mounting board 40 is included in the "board" recited in the Claims.

The case 50 is a low-profile, cylindrical case surrounding the light-emission-side of the lamp 1. Specifically, the upper part of the case 50 is secured to the support 20 by way of the securing screws 60, and the light-transmissive cover 90 is attached to the bottom part of the case 50. In addition, the filling component 30, the mounting board 40, the circuit board 70, and the reflecting mirror 80 are disposed inside the case 50. The case 50 is configured of a resin case made of a synthetic resin having insulation properties, such as polybutylene terephthalate (PBT).

Furthermore, as shown in FIG. 1A, the case 50 includes the electrical connection pins 52 which are power receiving units that receive power for causing the LED chip mounted on the mounting board 40 to emit light. Specifically, the electrical connection pins 52 for supplying power receive alternating-current (AC) power, and the received AC power is input to the circuit board 70 via a lead wire. Detailed description of the configuration of the case 50 shall be provided later.

The securing screws 60 are screws for securing the case 50 to the support 20. It should be noted the case 50 and the support 20 are not limited to being secured using screws. For example, the case 50 and the support 20 may have interfitting parts, and the case 50 may be connected to the support 20 through the interfitting of these parts. Alternatively, the case 50 may be joined to the support 20 by using an adhesive.

The circuit board 70 is a power source circuit board for causing the LED chip mounted on the mounting board 40 to emit light. The circuit board 70 is a disk-shaped board in which a circular opening is formed (i.e., donut-shaped board), and is disposed inside the case 50 and outside the reflecting mirror 80. In addition, the circuit element (electronic component) mounted on the circuit board 70 is disposed in the space inside the case 50 and outside the reflecting mirror 80.

Furthermore, since the circuit board 70 is disposed in the upper part of the inside of the case 50, it is preferable that a circuit element in which the size of, for example, an electrolytic capacitor, choke coil, or the like, is large, be disposed on the bottom face-side of the circuit board 70. It should be noted that although the circuit board 70 is illustrated in this embodiment in a form that is displaced inside the case 50 and outside the reflecting mirror 80, the placement location is not particularly limited and may be arbitrarily designed.

Moreover, in the form in which the circuit board 70 is disposed inside the case 50 and outside the reflecting mirror 80, it is preferable that a large-sized circuit element be disposed on the outer portion of the circuit board 70. This is because, as shown in FIG. 2, when the reflecting mirror has a shape in which the radius widens towards the bottom, the space formed in the outer portion of the circuit board 70 is larger than the space formed in the inner portion of the circuit board 70.

Specifically, a circuit element (electronic component), or the like, for converting the AC power received from the electrical connection pins 52 for supplying power into direct-current (DC) power is mounted on the circuit board 70. Specifically, the input unit of the circuit board 70 and the electrical connection pins 52 for supplying power are electrically connected by a lead wire or the like, and the output unit of the circuit board 70 and the light-emitting unit of the mounting board 40 are electrically connected by a lead wire or the like. The DC power obtained from the conversion by the circuit board 70 is supplied to the light-emitting unit of the mounting board 40, via a power supply terminal.

The reflecting mirror 80 is an optical component which is disposed on the light-emission-side of the mounting board 40, and reflects light emitted from the light-emitting unit. In other words, the reflecting mirror 80 reflects, downward, the outgoing light emitted from the light-emitting unit provided in the mounting board 40. Specifically, the reflecting mirror 80 is disposed below the mounting board 40 and inside the case 50, and includes a cylindrical part which is formed to have an inner diameter that gradually increases towards the bottom.

Furthermore, the reflecting mirror 80 is made of a white synthetic resin material having insulation properties. Although it is preferable that the material of the reflecting mirror 80 be a polycarbonate, it is not limited to polycarbonate. It should be noted that, in order to improve reflectivity, the inner face of the reflecting mirror 80 may be coated with a reflective film. It should be noted that the reflecting mirror 80 is included in the "reflecting part" recited in the Claims.

The light-transmissive cover 90 is a low-profile, cylindrical component having a disk-shaped bottom, which is attached to the bottom face of the case 50 in order to protect the components disposed inside the case 50. The light-transmissive cover 90 is secured to the bottom face of the case 50 by adhesive, rivets, screws, or the like. Furthermore, the light-transmissive cover 90 is made of a highly light-transmissive synthetic resin material such as polycarbonate so as to allow transmission of the outgoing light emitted from the light-emitting unit provided in the mounting board 40. It should be noted that paint for promoting light-diffusion may be applied to the inner face of the light-transmissive cover 90. Furthermore, phosphor may be included in the light-transmissive cover 90. In this case, the color of the light emitted from the light-emitting unit can be converted by the light-transmissive cover 90.

Next, details of the configuration of the case 50 shall be described.

Figure 4:
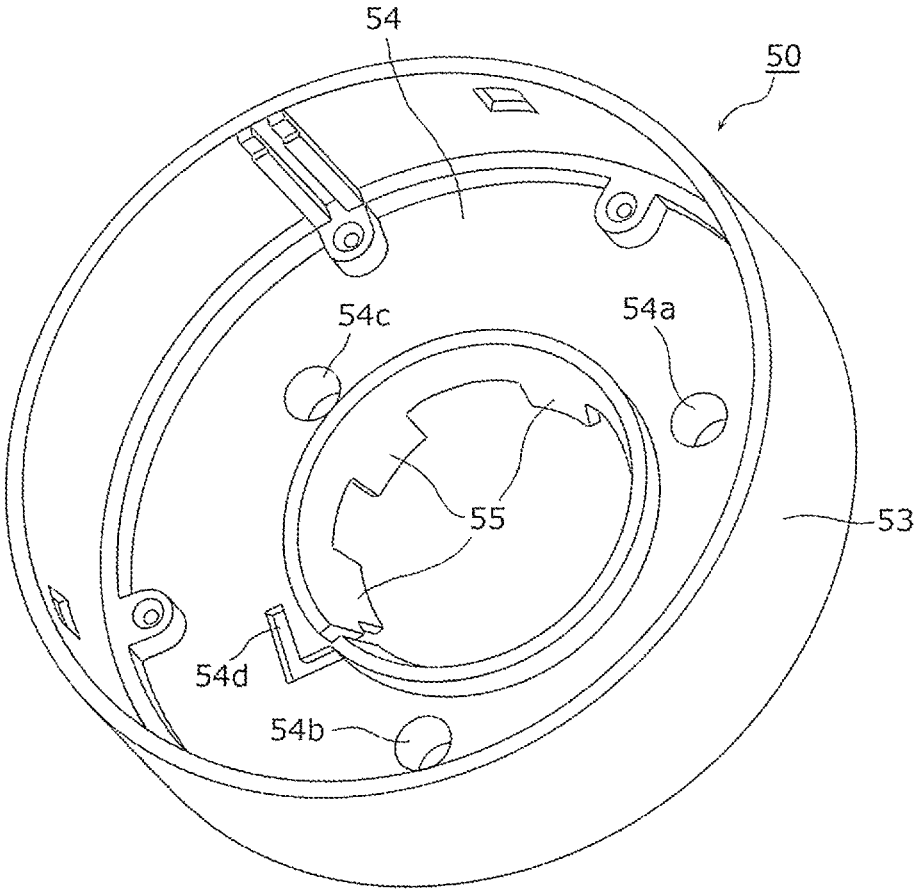
FIG. 4 is a perspective view of a configuration of a case according to Embodiment 1 of the present invention.

FIG. 4 is a perspective view of the configuration of the case 50 according to Embodiment 1 of the present invention. Specifically, the figure is a perspective view for when the case 50 is viewed obliquely from below.

As shown in the figure, the case 50, includes an annular side face part 53, a disk-shaped top face part 54 disposed above the side face part 53 and having a circular opening formed therein, and a securing part 55 that projects upward from inside the opening of the top face part 54. In other words, the case 50 is formed to curve inward towards the support 20-side.

Furthermore, screw insertion parts 54*a* to 54*c* for the insertion of the securing screws 60 are formed in the top face part 54. Specifically, three securing screws 60 are respectively inserted in the screw insertion parts 54*a* to 54*c*, and the case 50 and the support 20 are fastened by being screwed together. Furthermore, a cut-out part 54*d* for regulating the arrangement of the lead wire from the light-emitting unit provided in the mounting board 40. In other words, since the arrangement of the lead wire is regulated through the cut-out part 54*d*, assembly work, and the like, can be performed smoothly.

The securing part 55 is disposed below the mounting board 40 and has plural projecting parts that project toward the mounting board 40. In addition, the securing part 55 secures the mounting board 40 to the support 20 by sandwiching the mounting board 40 between the projecting parts and the support 20. It should be noted that although the securing part 55 includes five projecting parts in this embodiment, the number of the projecting parts is not limited to such.

Here, it is preferable that the securing part 55 include three or more projecting parts (or that there are three or more of the securing parts 55). Accordingly, since there will be three or more locations for the connection points between the securing part 55 and the mounting board 40, the securing part 55 can stably secure the mounting board 40 to the support 20.

Next, details of the configuration of the support 20 and the mounting board 40 shall be described.

Figure 5:
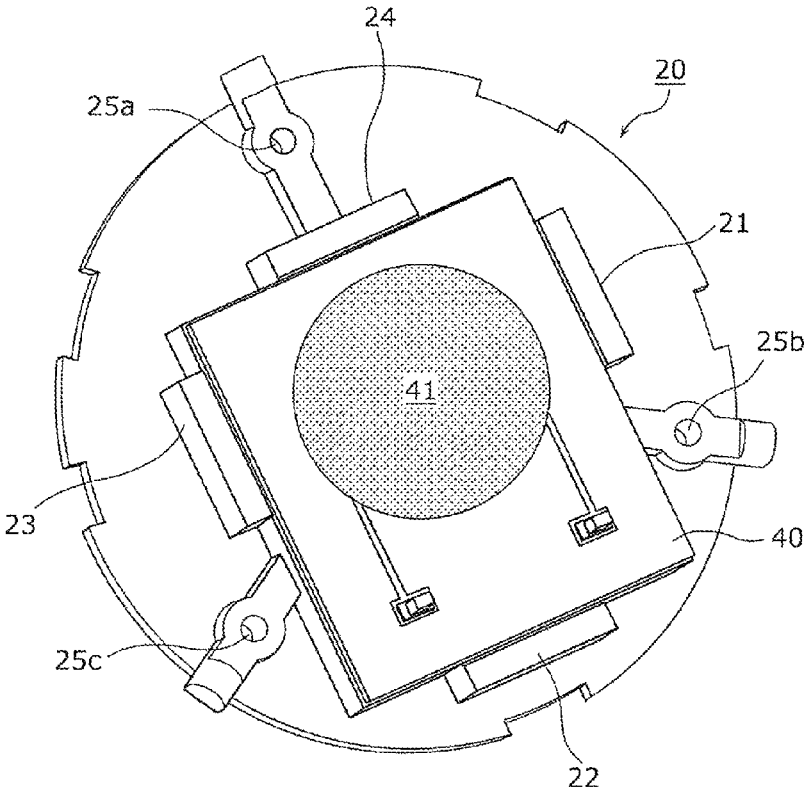
FIG. 5 is a perspective view of a configuration of a support and a mounting board according to Embodiment 1 of the present invention.

FIG. 5 is a perspective view of the configuration of the support 20 and the mounting board 40 according to Embodiment 1 of the present invention. Specifically, the figure is a perspective view for when the support 20 and the mounting board 40 are viewed obliquely from below.

As shown in the figure, the support 20 is a disk-shaped plate-like component, and includes, in a bottom face part, guide components 21 to 24 for positioning the mounting board 40. Specifically, when the mounting board 40 is placed on the support 20, the position of the mounting board 40 in the four directions, namely, forward, backward, left, and right, are set using the guide components 21 to 24. It should be noted that the guide components 21 to 24 can also be used to perform the positioning of the filling component 30.

In this manner, because the support 20 on which the mounting board 40 is to be placed includes the guide components 21 to 24, the mounting board 40 can easily be placed in a precise position on the support 20.

Furthermore, screw insertion parts 25*a* to 25*c* for the insertion of the securing screws 60 are formed in the support 20. Here, each of the screw insertion parts 25*a* to 25*c* corresponds to a different one of the screw insertion parts 54*a* to 54*c* of the case 50. Specifically, the three securing screws 60 are respectively inserted in the screw insertion parts 54*a* to 54*c* of the case 50 and the screw insertion parts 25*a* to 25*c* of the support 20, and the case 50 and the support 20 are fastened by being screwed together.

Furthermore, a light-emitting unit 41 is provided in the mounting board 40. The light-emitting unit 41 includes plural LED chips (not illustrated) mounted on the mounting board 40, and a sealing component (not illustrated). The LED chips are mounted on one of the faces of the mounting board 40 by die bonding, or the like. It should be noted that, for example, blue LED chips which emit blue light having a central wavelength at between 440 and 470 nm are used as the LED chips. Furthermore, the sealing component is a phosphor-containing resin made of a resin containing phosphor, for protecting the LED chips by sealing the LED chips, as well as for converting the wavelength of the light from the LED chips. As a sealing component, for example, in the case where the LED chips are blue light-emitting LEDs, a phosphor-containing resin in which yttrium, aluminum, and garnet (YAG) series yellow phosphor particles are dispersed in silicone resin can be used to obtain white light. With this, white light is emitted from the light-emitting unit 41 (sealing component) due to the yellow light obtained through the wavelength conversion by the phosphor particles and the blue light from the blue LED chips.

Further, the outer diameter of the light-emitting unit 41 is, for example, between 5 and 50 mm, and when the lamp 1 is a 20 W LED lamp, the outer diameter of the light-emitting unit 41 is, for example, 20 mm.

It should be noted that although a round light-emitting unit 41 is given as an example in this embodiment, the shape or structure of the light-emitting unit in the present invention is not limited to a round one. For example, a square-shaped light-emitting unit may be used. Furthermore, although the case where there are two power supply terminals is exemplified in the present embodiment, a structure having only one power supply terminal is acceptable. Furthermore, the arrangement of the LED chips is not particularly limited. For example, the LED chips may be sealed in a line, matrix, or circular form.

Next, details of the configuration of the lamp 1 in a state where the case 50 is secured to the support 20 shall be described.

Figure 6:
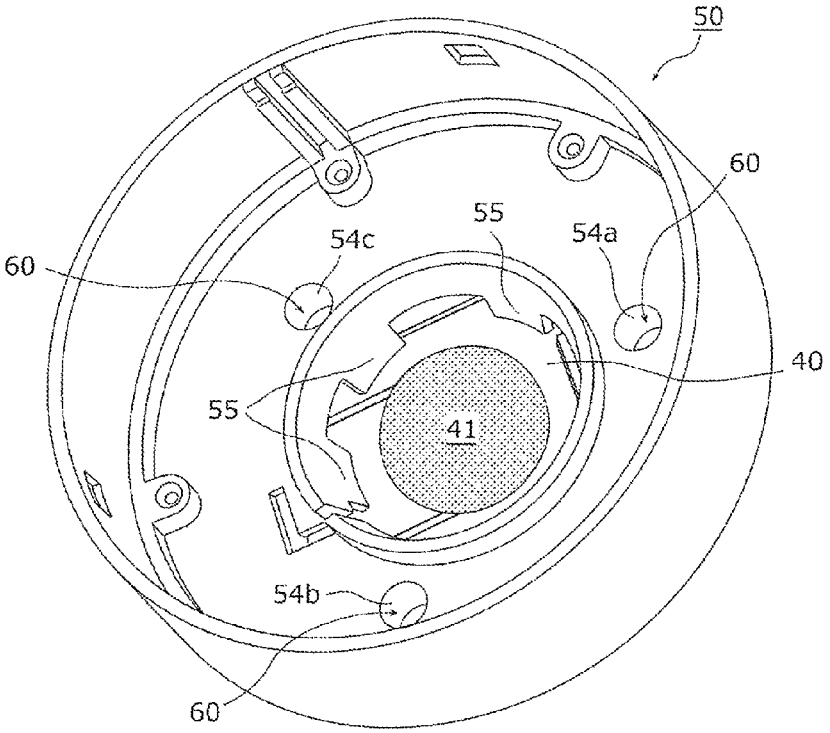
FIG. 6 is a diagram showing a configuration of the lamp in a state where the case is secured to the support according to Embodiment 1 of the present invention.
Figure 7:
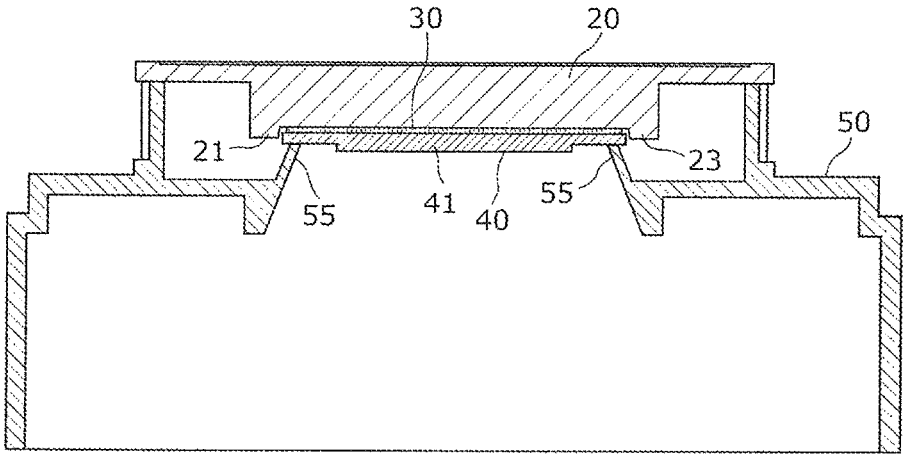
FIG. 7 is a diagram showing the configuration of the lamp in the state where the case is secured to the support according to Embodiment 1 of the present invention.

FIG. 6 and FIG. 7 are diagrams showing the configuration of the lamp 1 in the state where the case 50 is secured to the support 20 according to Embodiment 1 of the present invention. Specifically, FIG. 6 is a perspective view of the lamp 1 in the state where the case 50 is secured to the support 20 as seen from obliquely below, and FIG. 7 is a cross-sectional view that is obtained when the lamp 1 in the state where the case 50 which is secured to the support 20 is cut vertically.

As shown in the figures, the securing part 55 is disposed on the light-emission-side (underside) of the mounting board 40, and the support 20 and the case 50 are secured by the three securing screws 60 such that the mounting board 40 is sandwiched between the securing part 55 and the support 20.

Here, the securing part 55 is disposed so as to abut the mounting board 40 from an oblique direction. Specifically, although an elastic force in the vertical direction is not easily created in the securing part 55 when the securing part 55 abuts the mounting board 40 from the vertical direction, by having the securing part 55 abut the mounting board 40 from an oblique direction, an elastic force in the vertical direction is created in the securing part 55.

In this manner, by abutting the mounting board 40 from an oblique direction, the securing part 55 exerts a pressing force against the mounting board 40, and the mounting board 40 is secured to the support 20 by way of this pressing force. In other words, the securing part 55 secures the mounting board 40 to the support 20 by pressing the mounting board 40 against the support 20. It should be noted that, although not particularly limited, it is preferable that the magnitude of this biasing force be greater than or equal to 5 N.

Accordingly, since the securing part 55 exerts a force that presses the mounting board 40 against the support 20, the mounting board 40 can be reliably secured to the support 40 by sandwiching the mounting board 40 between the securing part 55 and the support 20.

It should be noted that although the securing part 55 abuts the mounting board 40 from an oblique direction in this embodiment, abutting the mounting board 40 from a vertical direction is also acceptable. In this case, as long as the securing part 55 is made of a material having elasticity in the vertical direction, the same advantageous effect as in the above-described embodiment is produced even when abutting the mounting board 40 from a vertical direction.

Furthermore, as shown in FIG. 6, it is preferable that the securing part 55 abuts the mounting board 40 in a manner which avoids the wires of the mounting board 40. In this case, it is possible to prevent the placing of a load on the wires of the mounting board 40 brought about by the securing part 55 coming into contact with the wires.

As described above, according to the lamp 1 according to Embodiment 1, the case 50 includes the securing part 55 which secures the mounting board 40 to the support 20 by sandwiching the mounting board 40 between the case 50 and the support 20. As such, since it is possible to secure the mounting board 20 to the support 20 by sandwiching the mounting board 40 between the case 50 and the support 20, a special component for securing the mounting board 40 to the support 20 is not required. Therefore, it is possible to secure the LED board to the support, using a simple configuration.

Furthermore, since a special component for securing the mounting board 40 to the support 20 is not required, material cost and assembly cost can be reduced, and thus product cost can be reduced.

Embodiment 2

Next, a lighting apparatus 100 according to Embodiment 2 of the present invention shall be described.

Figure 8:
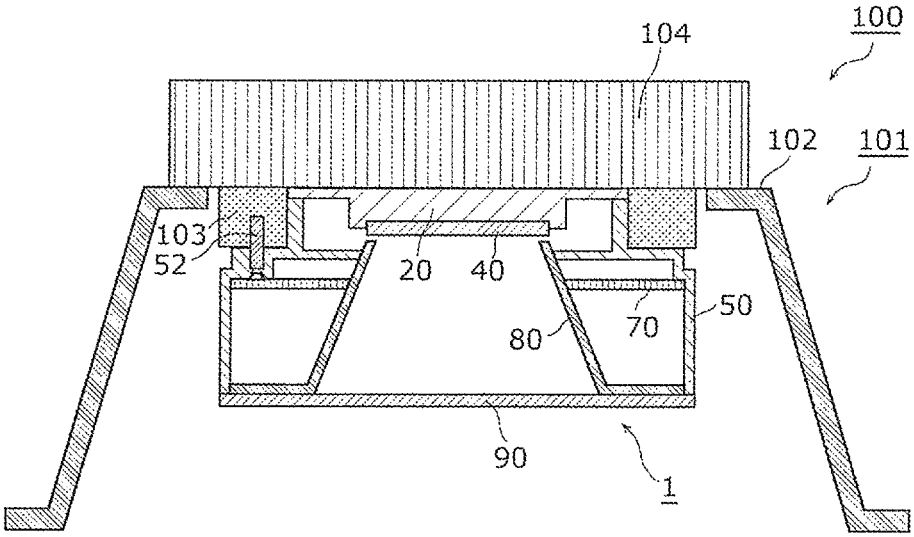
FIG. 8 is a cross-sectional view of a configuration of a lighting apparatus according to Embodiment 2 of the present invention.

FIG. 8 is a cross-sectional view of a configuration of the lighting apparatus 100 according to Embodiment 2 of the present invention. It should be noted that the lamp 1 according to Embodiment 1 is used in the lighting apparatus according to this embodiment. Therefore, in the figure, the same reference signs are given to structural components that are the same as the structural components shown in Embodiment 1.

As shown in the figure, the lighting apparatus 100 is, for example, a downlight and includes lighting equipment 101, and the lamp 1 according to Embodiment 1. The lighting equipment 101 includes: a main body which includes a reflecting plate 102 and a heat-dissipating component 104 and is configured to cover the lamp 1; and a socket 103 attached to the main body.

The reflecting plate 102 is substantially in the shape of a cup having a circular opening formed on the top face, and is configured so as to laterally surround the lamp 1. Specifically, the reflecting plate 102 includes: as the top face, a circular flat plate part in which a circular opening is formed; and a cylinder part that is formed to have an inner diameter which gradually widens from the periphery of the flat plate part to the bottom. The cylinder part has an opening on the light-emission-side, and is configured to reflect the light from the lamp 1. For example, the reflecting plate 102 is made of a white synthetic resin having insulation properties. It should be noted that, in order to improve reflectivity, the inner face of the reflecting plate 102 may be coated with a reflective film. Moreover, the reflecting plate 102 is not limited to a reflecting plate made of synthetic resin, and a metal reflective plate formed from a pressed metal plate may be used.

The socket 103 is compatible with the GH76p base, and is a disk-shaped component that supplies AC power to the lamp 1. The socket 103 is arranged so that its upper part is inserted inside the opening formed in the flat plate part in the top face of the reflecting plate 102. An opening part shaped to conform to the shape of the base of the support 20 is formed at the center of the socket 103, and the top face of the lamp 1 and the bottom face of the heat-dissipating component 104 are thermally connected by installing the lamp 1 in such opening part. Furthermore, a connection hole into which an electrical connection pin 52 is inserted is formed at a position at the bottom part of the socket 103 which corresponds to the electrical connection pin 52 of the case 50.

The heat-dissipating component 104 is a component which dissipates the heat transmitted from the lamp 1. The heat-dissipating component 104 is disposed to abut the top face of the reflecting plate 102 and the top face of the socket 103. It is preferable that the heat-dissipating component 104 be made of highly heat-conductive material such as aluminum.

It should be noted that the lamp 1 is installed in the socket 103 in a removable manner.

As described above, according to the lighting apparatus 100 according to Embodiment 2 of the present invention, the inclusion of the lamp 1 according to Embodiment 1 makes it possible to produce the same advantageous effects as in Embodiment 1.

(Modification)

Next, a modification of the lamp according to the previously-described embodiments of the present invention shall be described.

Figure 9:
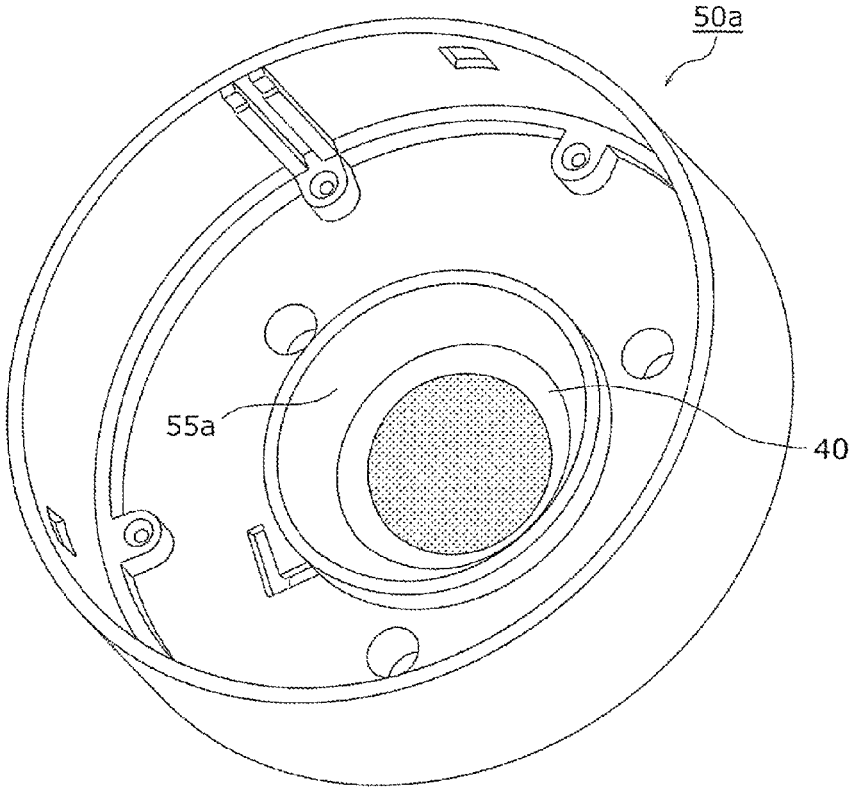
FIG. 9 is a perspective view of a configuration of a case according to a modification of an embodiment of the present invention.
Figure 10:
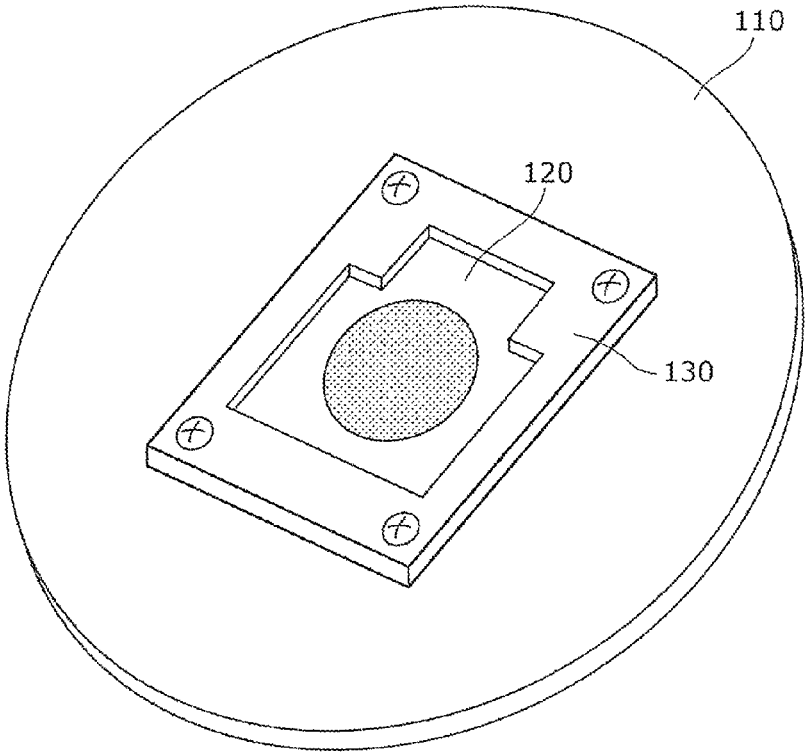
FIG. 10 is a diagram showing a configuration for securing an LED board to a support, in a conventional LED lamp.

FIG. 9 is a perspective view of a configuration of a case 50*a* according to a modification of the embodiments of the present invention. Specifically, the figure is a perspective view for when the case 50*a* which is secured to the support 20 is viewed obliquely from below.

As shown in the figure, the case 50*a* includes a securing part 55*a* in place of the securing part 55 in Embodiment 1. Specifically, whereas the securing part 55 in Embodiment 1 includes five projecting parts, the securing part 55*a* is a single cylindrical projecting part that projects toward the mounting board 40.

Furthermore, in the same manner as in Embodiment 1, the securing part 55*a* is disposed on the light-emission-side (underside) of the mounting board 40, and secures the mounting board 40 to the support 20 by sandwiching the mounting board 40 between the securing part 55 and the support 20. It should be noted that in this modification, it is preferable that the securing part 55*a* be formed using an elastic component.

As described above, according to the lamp according to this modification, the mounting board 40 can be secured to the support 20 by sandwiching the mounting board 40 between the securing part 55*a* and the support 20, and thus the same advantageous effects as in Embodiment 1 can be produced.

Although lamps and a lighting apparatus according to the embodiments of the present invention and a modification thereof have been described, the present invention is not limited to the above-described embodiments and modification thereof.

Specifically, the embodiments and modification thereof disclosed herein should be considered, in all points, as examples and are thus not limiting. The scope of the present invention is defined not by the foregoing description but by the Claims, and includes all modifications that have equivalent meaning to and/or are within the scope of the Claims. Furthermore, forms obtained by arbitrarily combining the above-described embodiments and modification are also included in the scope of the present invention.

For example, although the case 50 is a cylindrical component in the above-described embodiments and modification, the shape of the case 50 is not limited to such. For example, the case 50 may be configured in a polygonal cylinder-shape such as a quadrangular cylinder, a pentagonal cylinder, a hexagonal cylinder, or an octagonal cylinder, or in a truncated cone-shape.

Furthermore, although the case 50 and the reflecting mirror 80 are separate components in the above-described embodiments and modification, the case 50 and the reflecting mirror 80 may be formed as a single component.

Furthermore, although the filling component 30, the mounting board 40, the circuit board 70, and the reflecting mirror 80 are disposed inside the case 50 in the above-described embodiments and modification, each of these components may be entirely or partially disposed outside the case 50. It should be noted that when only part of the reflecting mirror 80 is disposed inside the case 50, the part of the reflecting mirror 80 that is disposed inside the case 50 corresponds to the "reflecting part" recited in the Claims.

Furthermore, although the support 20 includes a base in the above-described embodiments and modification, the base need not be integrated with the support 20 and may be a separate component.

Furthermore, optical components such as a lens or reflector for focusing the light from the light-emitting unit 41, or optical filters, and the like, for color tone-adjustment may be used in the above-described embodiments and modification. However, such components are not essential components for the present invention.

Furthermore, although LEDs are used as an example of light-emitting elements in the above-described embodiments and modification, other light-emitting elements such as semiconductor lasers or organic electro luminescence (EL) devices may also be used.

INDUSTRIAL APPLICABILITY

Lamps according to the present invention can be widely used as a lamp, or the like, that includes, for example, a GH76p base.

REFERENCE SIGNS LIST

1 Lamp
10 Heat-conducting sheet
20 Support
21-24 Guide component
25*a*-25*c* Screw insertion part
30 Filling component
40 Mounting board
41 Light-emitting unit
50, 50*a* Case
51, 51*a*-51*e* Through hole
52, 52*a*-52*e* Electrical connection pin
53 Side face part
54 Top face part
54*a*-54*c* Screw insertion part
54*d* Cut-out part
55, 55*a* Securing part
60 Securing screws
70 Circuit board
80 Reflecting mirror
90 Light-transmissive cover
100 Lighting apparatus
101 Lighting equipment
102 Reflecting plate
103 Socket
104 Light-dissipating component
110 Support
120 LED board
130 Securing component

The invention claimed is:

1. A lamp that emits light, the lamp comprising:
a board on which a light-emitting element is provided;
a support disposed on a side opposite a light-emission-side of the board; and
a case connected to the support, and the case comprises:
a side face;
a top face that is disposed on a support-side of the side face and in which an opening is provided; and
a securing part which is disposed on the light-emission-side of the board, has a plurality of projections, and secures the board to the support by sandwiching the board between the securing part and the support,
wherein the plurality of projections project from inside the opening of the top face of the case, extend through the opening and beyond the top face in a direction of the support, and secure the board to the support by sandwiching the board between the plurality of projections and the support.

2. The lamp according to claim 1, further comprising
a reflector which is disposed on the light-emission-side of the board, and reflects light emitted from the light-emitting element,
wherein the reflector is disposed inside the case.

3. The lamp according to claim 1,
wherein the securing part secures the board to the support by exerting a pressing force against the board.

4. The lamp according to claim 1,
wherein the securing part is disposed to abut the board from an oblique direction.

5. The lamp according to claim 1, further comprising
a filling component which is disposed between the board and the support, and fills a space between the board and the support.

6. The lamp according to claim 5,
wherein the filling component is a heat-conducting sheet that thermally connects the board and the support.

7. The lamp according to claim 5,
wherein the filling component is an insulating sheet that provides insulation between the board and the support.

8. The lamp according to claim 1,
wherein the support includes a guide component for positioning the board.

9. A lighting apparatus comprising:
the lamp according to claim 1; and
lighting equipment to which the lamp is attached,
wherein the lighting equipment includes:
a main body configured to cover the lamp; and
a socket attached to the main body, for supplying power to the lamp.

10. The lamp according to claim 1, said plurality of projections extend through the opening of the top face and engage the board to maintain the board spaced from the top face.

11. The lamp according to claim 1, said securing part is configured to support said board spaced from said top face of said case.

12. The lamp according to claim 1, said plurality of projections being integral with the opening of the top face.

13. The lamp according to claim 1, said securing part configured to abut against a major surface of said support.

* * * * *